United States Patent [19]

Cavanagh

[11] 4,301,979

[45] Nov. 24, 1981

[54] WINCH

[76] Inventor: Paul D. Cavanagh, 495 Newbury St., Danvers, Mass. 01923

[21] Appl. No.: 122,756

[22] Filed: Feb. 19, 1980

[51] Int. Cl.[3] ..... B66D 1/30; B65H 75/28

[52] U.S. Cl. ..... 242/217; 242/125.2; 254/371

[58] Field of Search ..... 254/264, 342, 344, 374, 254/371, 372; 242/117, 125.2; 24/130, 114.5

[56] References Cited

U.S. PATENT DOCUMENTS 2,264,555 12/1941 Rogers ..... 242/117

2,374,111 4/1945 Le Tourneau ..... 242/117

3,712,155 1/1973 Stommel ..... 254/342

FOREIGN PATENT DOCUMENTS 1256582 12/1967 Fed. Rep. of Germany ..... 24/130

*Primary Examiner*—Billy S. Taylor

*Attorney, Agent, or Firm*—C. Yardley Chittick

[57] ABSTRACT

In a winch or capstan, means for holding the free end of a rope in readily releasable condition but with sufficient force to insure that the turns of rope on the winch drum will not slip as the rope under tension is being wound thereon.

2 Claims, 4 Drawing Figures

WINCH

BACKGROUND OF THE INVENTION

Winches are in common use on sailboats for trimming and hoisting sails. The typical winch includes an overrunning ratchet mechanism permitting rotation of the winch drum in one direction only, customarily clockwise. The usual practice in trimming a jib, for example, is to place one or two turns of the rope or line (on sailboats, called the sheet) that controls the angle of the sail, around the winch in a clockwise direction, pull on the free end of the rope to bring the rope into sufficient frictional engagement with the winch drum to hold the rope against the pull of the jib. Then while still holding the free end in tension with one hand, the operator commences rotation of the hand crank to wind the rope on the winch drum to the extent desired.

As the rope is wound on the winch, the free end of the rope, unwinding from the winch, must continue to be held in tension by the operator to maintain the necessary friction between the rope and drum. Failure to hold the unwinding free end of the rope in tension will cause the turns to become slack and the rope will slip.

Thus it will be understood that when the winch is operated by one person, both hands must be actively used, one hand turning the winch and the other keeping the free end of the rope in tension.

In situations where the load on the rope is so great that the operator must use both hands to turn the crank, then a second person is required to hold the free end in tension until the trimming of the sail is completed.

Upon completion of the trimming, the free end may continue to be held under tension if further sail adjustment is contemplated shortly or more usually the free end is temporarily secured to a cleat.

SUMMARY OF THE PRESENT INVENTION

The object of the present invention is to eliminate the necessity of manually holding the free end of the rope under tension while the winch is being actuated. This is accomplished by having means on the top of the winch designed to receive and grip the free end of the rope with sufficient frictional effect to apply the necessary tension to the rope to prevent slipping as the rope is wound on the winch drum.

It is to be understood that the use of the term winch includes other similar devices such as a capstan or any cantilevered drum on which a rope is to be wound. Likewise the term rope includes all types of flexible tension elements capable of being wound on a winch drum, such as lines and sheets.

DESCRIPTION OF A PREFERRED EMBODIMENT

Figure 1:
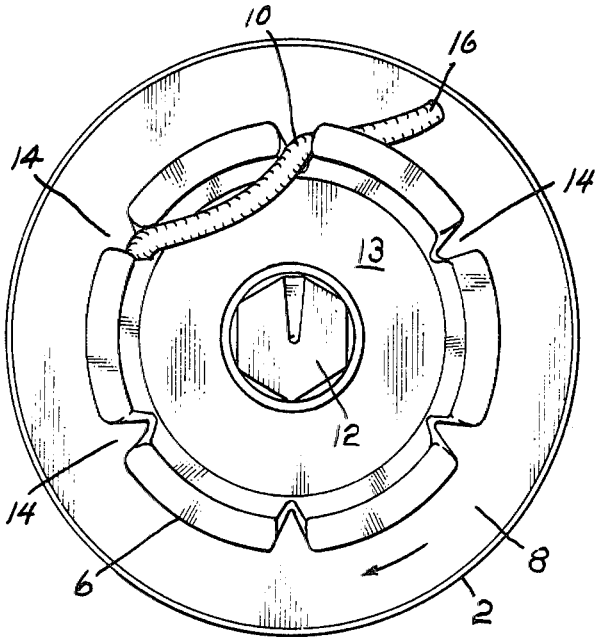
FIG. 1 is a plan view of a winch incorporating the invention.
Figure 2:
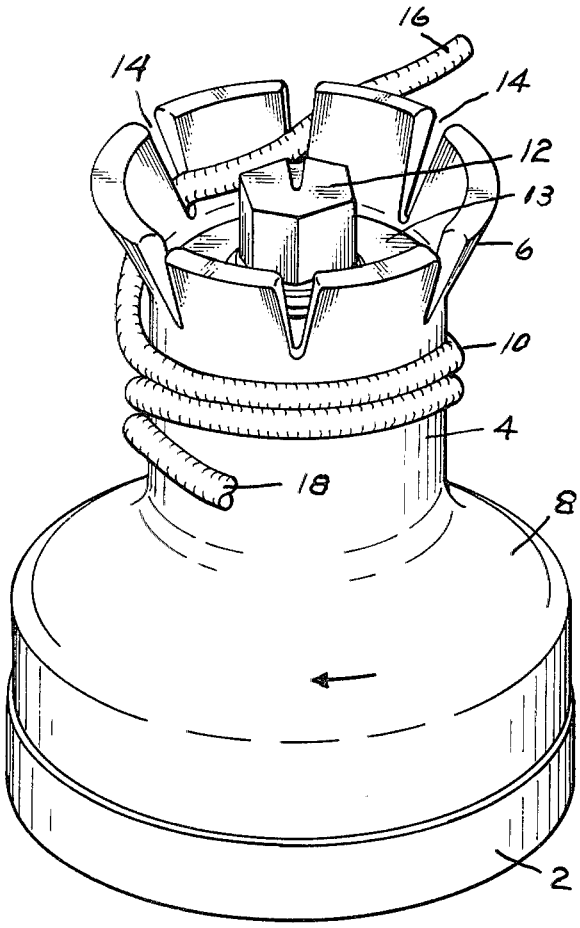
FIG. 2 is a perspective view of FIG. 1.

Referring first to FIGS. 1 and 2, a winch of generally conventional configuration is shown. The winch comprises a base 2 and a rotatable drum 4. The base 2 is secured to a fixed support (not shown) strong enough to carry the loads to be applied to the winch.

The drum 4 is mounted on the base 2 for axial rotation in one direction only, usually clockwise as indicated by the curved arrow.

The upper end of the drum is flared as at 6 and the lower end flared as at 8 to maintain in position the rope 10 that is wound thereon.

Means for receiving a hand crank (not shown) to turn the winch drum is shown in the form of a hexagonal stud 12 extending axially from end wall 13.

The winch thus far described is of conventional construction and is intended to be representative of any cantilevered type winch on which a rope under tension is wound by manual or power rotation of the winch drum.

The important novel element of the winch is the construction on the outer end of the drum whereby a portion of the free end of the rope may be temporarily held while the rope is being wound thereon.

As can be seen in FIGS. 1 and 2, the flared end 6 has a plurality of notches 14 therein. These notches are tapered, being wide enough at their outer ends to receive the largest rope to be used on the drum and narrow enough at their inner ends to grip the smallest rope to be used. The edges of the notches are at an angle sufficiently acute to increase the grip on the sides of the rope when placed in zigzag fashion in adjacent notches. The inner ends of the notches are adjacent the end wall 13.

In the use of the winch, the operator places one or two or more turns of the rope on the drum. Two turns are shown in FIG. 2. A portion of the free end 16 is then placed preferably in two adjacent notches. At this point there will probably be some limited tension on the standing part 18 of the rope, but in any case, the rope is secured on the winch and the operator's hands are freed.

The operator then applies the hand crank to the stud 12 and commences clockwise rotation of drum 4 to pull in the rope 10 to the extent required to trim the sail or other element attached to part 18.

The holding power of the notches 14 on the free end of the rope is always adequate to enable the required friction between the initial turns of the rope and the drum to develop when the drum is rotated. When the trimming is completed, the free end is allowed to remain in the notches, where it is sufficiently secure without connecting it to a cleat.

The conventional internal winch mechanism precludes counter clockwise rotation of drum 4. Thus when it is desired to free or slack off on rope 10, the free end 16 is lifted from notches 14, permitting the turns on the drum to lose their frictional hold so that the rope can run off the drum to the extent required. Rope movement can be stopped at any time by pulling on the free end and then by placing the free end in two or more notches, the status can be maintained.

When reference has been made heretofore to the "free end" of rope 10, it will be understood that the free end, extending beyond notches 14, is of indeterminate length depending on the length of the rope and the position of the object to which the standing part is affixed.

If the operator has any doubt about the holding power of two notches on the free end of the rope, then additional security may be obtained by zigzagging the free end into additional notches.

DESCRIPTION OF A MODIFICATION

Figure 3:
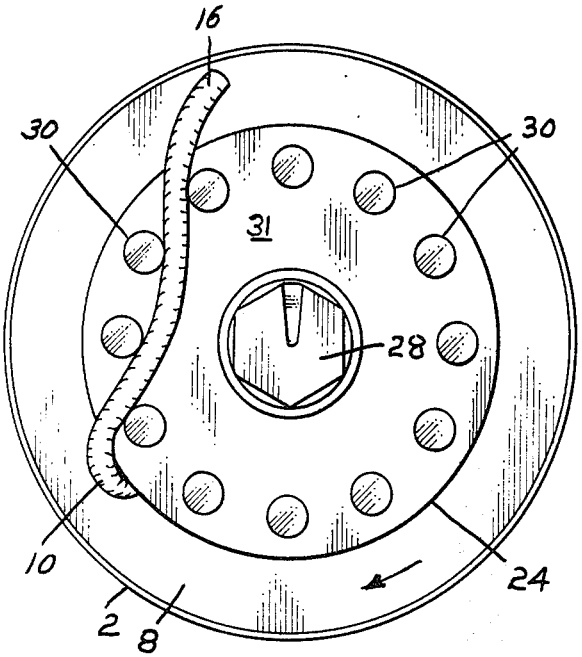
FIG. 3 is a plan view of a modification.
Figure 4:
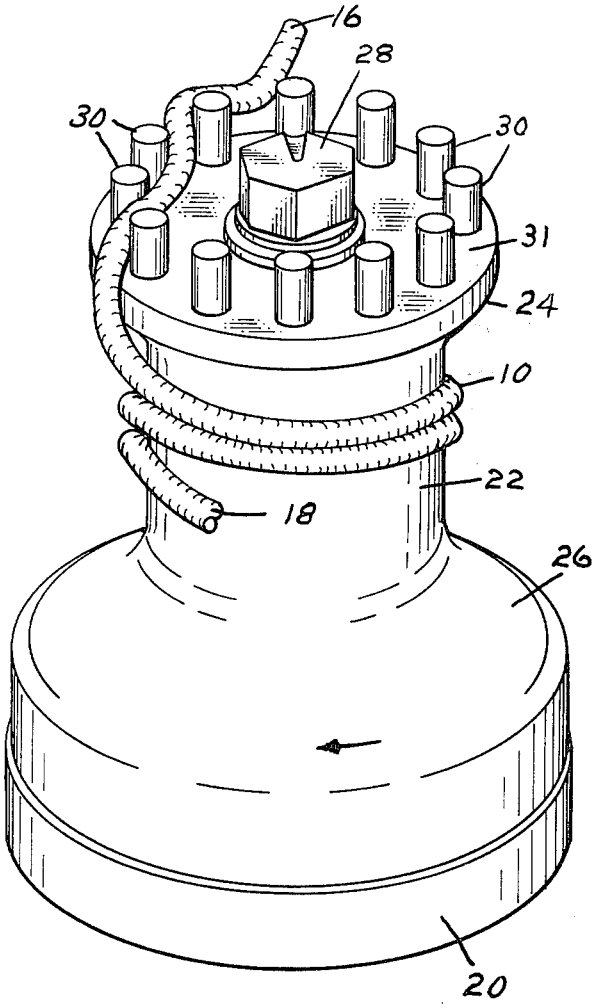
FIG. 4 is a perspective view of FIG. 3.

The winch illustrated in FIGS. 3 and 4 is similar to that shown in FIGS. 1 and 2, the principal difference residing in the means for securing the free end.

The winch comprises a base 20 and drum 22 flared at the top at 24 and at the bottom at 26. The axially located hexagonal stud 28 is designed to receive a crank (not shown) whereby the drum may be rotated.

A plurality of pins 30 of adequate strength are secured to the end wall 31 of drum 22. The pins are spaced so that a portion of the free end 16 of rope 10 may be zigzagged therethrough in a manner to apply sufficient longitudinal holding force to the rope so that when the drum, with one or more turns of rope thereon, is rotated clockwise, adequate friction will develop between the turns and drum to hold the rope against slipping.

The disposition of the free end of the rope between the pins 30 is obviously dictacted by the size of the rope in relation to the pin diameter and pin spacing. Adequate frictional holding force is always obtainable. The pins could be of other selected cross sections, such as square, hexagonal, etc.

The use and operation of the species disclosed in FIGS. 3 and 4 is the same as that previously explained with respect to FIGS. 1 and 2.

The foregoing disclosures of the invention may suggest other modifications to those familiar with this art which will fall within the scope of the appended claims.

I claim:

1. A winch comprising a base and a rotatable circular drum mounted thereon, said drum having an upper end, means for rotating said drum, said means being located axially of said drum, the upper end of said drum having extending upwardly therefrom a circular wall flaring outwardly at an angle from the vertical to control the position of turns of rope being wound on said drum, said flared end wall containing a plurality of tapered notches adapted to receive and to hold against longitudinal movement under the forces present in the operation of said winch, the free end of the rope when placed in at least two of said notches, said tapered notches being of such dimensions as to be wider at their upper ends and narrower at their lower ends than the diameter of the rope placed therein, and means located below the bottom of said notches and surrounding said drum rotating means for closing the upper end of said drum.

2. A winch as set forth in claim 1, said means for closing said drum comprising an annular transverse wall integral with said drum.

* * * * *